United States Patent [19]

Bishop et al.

[11] 4,296,195

[45] Oct. 20, 1981

[54] TWO-SHEET DIFFUSION TRANSFER ASSEMBLAGES AND PHOTOGRAPHIC ELEMENTS

[75] Inventors: John F. Bishop; Wayne A. Bowman, both of Rochester, N.Y.

[73] Assignee: Eastman Kodak Company, Rochester, N.Y.

[21] Appl. No.: 174,420

[22] Filed: Aug. 1, 1980

[51] Int. Cl.[3] ..... G03L 5/54; G03L 7/00; G03L 1/76

[52] U.S. Cl. ..... 430/215; 430/216; 430/237; 430/531; 430/533; 430/535; 430/536; 430/539

[58] Field of Search ..... 430/215, 216, 539, 531, 430/536, 535, 533, 236, 237

[56] References Cited

U.S. PATENT DOCUMENTS

| | | | |
|---|---|---|---|
| 2,776,219 | 1/1957 | Hoyt et al. | 106/128 |
| 3,746,564 | 7/1973 | Parsons | 430/215 |
| 3,877,947 | 4/1975 | Tsuji et al. | 96/87 |
| 4,054,722 | 10/1977 | Yoshida et al. | 428/522 |
| 4,061,496 | 12/1977 | Hannie et al. | 430/215 |
| 4,195,993 | 4/1980 | Kilminster et al. | 430/223 |

FOREIGN PATENT DOCUMENTS

| | | |
|---|---|---|
| 2388307 | 11/1978 | France . |
| 1194793 | 6/1970 | United Kingdom . |
| 1486446 | 9/1977 | United Kingdom . |

OTHER PUBLICATIONS

*Research Disclosure,* 7-75, Item No. 13525.

"Multilayer Receiving Elements . . . ", *Research Disclosure* No. 11346, 9/1973 pp. 56 & 57.

*Primary Examiner*—Edward C. Kimlin

*Attorney, Agent, or Firm*—H. E. Cole

[57] ABSTRACT

Two-sheet diffusion transfer assemblages and photographic elements are described which contain a primer layer located between a polymeric acid layer and a timing layer. The primer layer prevents unwanted transfer of portions of the emulsion layer to the receiver when the receiver and photographic element are peeled apart. The primer layer comprises:

(a) a mixture of gelatin and cellulose nitrate, or (b) a mixture of an acrylic acid copolymer and a particular acrylic acid terpolymer, or (c) an acrylic acid copolymer as described herein.

23 Claims, No Drawings

TWO-SHEET DIFFUSION TRANSFER ASSEMBLAGES AND PHOTOGRAPHIC ELEMENTS

This invention relates to photography, and more particularly to photographic elements and two-sheet photographic assemblages for diffusion transfer photography. A primer layer which is located between a polymeric acid layer and a timing layer prevents unwanted transfer of portions of the emulsion layers to the receiver when the receiver and photographic element are peeled apart. The primer layer comprises a mixture of gelatin and cellulose nitrate, or a mixture of an acrylic acid copolymer and a particular acrylic acid terpolymer, or an acrylic acid copolymer.

In a two-sheet image transfer process, a photosensitive or donor element is employed along with a dye image-receiving element. The receiving element usually comprises a support having thereon a dye image-receiving layer. The donor element comprises a support having thereon at least one photosensitive silver halide emulsion layer having associated therewith a dye image-providing material. The donor element also contains process control layers for terminating development after the required development has taken place. In general, the process control layers prevent any significant change in image formation from occurring beyond the optimum time required for development and useful transfer of dye. Such layers include one or more timing and acid layers.

In practice, the donor element is exposed, soaked in an activator or processing composition, and then laminated to the receiving element. An imagewise distribution of dye image-providing material from the donor diffuses to the receiving element. After a required period of time, the two elements are separated.

The physical parameters of this system are stringent. All layers of the donor and receiver must be uniformly coatable, be stable and have good dry and wet adhesion. The donor element must retain physical integrity while soaking in a highly alkaline processing composition for ten seconds or more at elevated temperatures ranging up to 32° C. The donor element must uniformly unite with the surface of the receiving element and, after passage through processing rollers, remain tightly in contact with the receiver without external pressure for the time required to transfer the dye image. This processing time may exceed ten minutes at temperatures which may vary over a wide range. Finally, the donor and receiving element must be cleanly separable without appreciable effort and produce no surface distortion in the receiving element.

It has been difficult to simultaneously meet all of the above objectives in a two-sheet diffusion transfer assemblage. A problem of poor wet adhesion between the timing layer and the adjacent polymeric acid layer has been encountered, which results in unwanted transfer of portions of the emulsion layers to the receiver when the donor and receiver are separated.

It is believed that this poor wet adhesion between the timing layer and polymeric acid layer occurs because of the large difference in lateral swell between these two layers when the processing composition diffuses throughout the photographic element.

It would be desirable to provide a photographic element for a two-sheet diffusion transfer assemblage which does not have poor wet adhesion between the polymeric acid and timing layers.

In *Research Disclosure* 11346, September 1973, an alkyl methacrylate interlayer between an acid layer and a timing layer is disclosed for use in an image-receiving element. There is no disclosure in this reference, however, of using this interlayer between a polymeric acid layer and a timing layer in a photographic element containing silver halide emulsion layers to prevent unwanted transfer of portions of the emulsion layer to a receiving element upon peel apart.

In British Patent No. 1,194,793, an acrylic acid copolymer is disclosed for use in a photographic element. Again, however, there is no disclosure of the use of this copolymer between a polymeric acid layer and a timing layer in a photographic element to prevent unwanted transfer of portions of the emulsion layers to a receiving element upon peel apart.

In U.S. Pat. No. 4,061,496, the use of two timing layers is disclosed. One of these timing layers can be poly(acrylonitrile-co-vinylidene chloride-coacrylic acid). The primer layer of the present invention is not disclosed in this patent, however, nor its use to obtain the advantages described herein.

In U.S. Pat. Nos. 2,776,219 and 3,746,564, gelatin and cellulose nitrate subbing solutions are disclosed. The use of such materials in a photographic element between a polymeric acid layer and a timing layer as described in this invention is not disclosed, however.

We have found that the use of certain primer layer compositions provides good wet adhesion during the lamination period, does not increase the force required to separate the donor from the receiver after development, and does not transfer any of the timing layer and/or emulsion layers to the receiver. These layers are coatable without special techniques, are stable and flexible, do not affect donor sensitometry, and do not materially affect the timing layer's breakdown time.

In accordance with our invention, a photographic element is provided which comprises a support having thereon, in order, a polymeric acid layer, a timing layer and at least one photosensitive silver halide emulsion layer having associated therewith a dye image-providing material, and wherein a primer layer is located between said polymeric acid layer and said timing layer, said primer layer comprising:

(a) a mixture of gelatin and cellulose nitrate; or (b) a mixture of an acrylic acid copolymer and an acrylic acid terpolymer, said acrylic acid copolymer comprising 60 to 90 weight percent of recurring units derived from acrylic acid and 10 to 40 weight percent of recurring units derived from an alkyl acrylate or alkyl methacrylate, wherein said alkyl group has 1 to about 10 carbon atoms, e.g., methyl acrylate, ethyl acrylate, n-butyl acrylate, methyl methacrylate, butyl methacrylate, hexyl acrylate, hexyl methacrylate, octyl acrylate, octyl methacrylate, decyl acrylate or decyl methacrylate; said acrylic acid terpolymer comprising 5 to 40 weight percent of recurring units derived from acrylic acid, 10 to 40 weight percent of recurring units derived from acrylonitrile and 20 to 85 weight percent of recurring units derived from vinylidene chloride, said acrylic acid copolymer comprising from about 40 to about 90 weight percent of said mixture, preferably from 55 to 65 weight percent; or (c) an acrylic acid copolymer comprising 5 to 30 weight percent of recurring units derived from acrylic acid and 70 to 95 weight percent of recurring units derived from an alkyl acrylate or alkyl methacrylate, wherein said alkyl group has 1 to about 10 carbon atoms, e.g., methyl acrylate, ethyl acrylate, n-butyl acrylate, methyl methacrylate, butyl methacrylate, hexyl acrylate, hexyl methacrylate, octyl acrylate, octyl methacrylate, decyl acrylate or decyl methacrylate.

The thickness or coverage of the primer layer can by any amount which will give the results desired. In general, coverages from 100 to about 2,500 mg/m$^2$ have given good results. In a preferred embodiment, 200 to about 1,500 mg/m$^2$ are employed.

A photographic assemblage in accordance with our invention comprises a photographic element as disclosed above and a dye image-receiving element comprising a support having thereon a dye image-receiving layer, said receiving element being adapted to be superposed on said photographic element after exposure thereof.

A process for producing a photographic image in accordance with our invention comprises immersing an exposed photographic element, as described above, in a processing composition, and then bringing the photographic element into face-to-face contact with a dye image-receiving element as described above. The exposed photographic element is immersed in the processing composition for periods of time ranging from 5 seconds to 30 seconds at temperatures from 15° C. to 30° C. to effect development of each of the exposed silver halide emulsion layers. The photographic element is then laminated to the dye image-receiving element by passing the two elements together in face-to-face contact through the nip of two rollers. The assemblage is then left laminated together for a period of time ranging from between 1 minute and 15 minutes. An imagewise distribution of dye image-providing material is thus formed as a function of development, and at least a portion of it diffuses to the dye image-receiving layer to provide the transfer image. The receiving element is then peeled apart from the photographic element. The image formed in the receiving element can either be a negative or a positive, depending upon whether or not the photosensitive emulsions employed in the donor element are negative emulsions or direct-positive emulsions, and depending on whether positive-working or negative-working image-forming chemistry is employed.

The mixture of gelatin and cellulose nitrate employed in this invention is preferably a stabilized composition of bone gelatin and cellulose nitrate. It can be coated from a compatible solvent mixture of water, methanol and acetone, for example. The concentration of cellulose nitrate in the mixture can be varied over a wide range. Particularly good results have been obtained when the cellulose nitrate comprises from about 1 to about 70 weight percent of the mixture. Suitable compositions are disclosed in U.S. Pat. Nos. 2,776,219 and 3,746,564, the disclosures of which are hereby incorporated by reference.

Suitable mixtures of acrylic acid terpolymers and acrylic acid copolymers useful in our invention include the following:

poly(acrylonitrile-co-vinylidene chloride-co-acrylic acid) (weight ratios of 12/68/20, 13/73/14, 15/68/17, 10/72/18, 15/63/22, 14/76/10 or 35/25/40) mixed with:

poly(n-butyl acrylate-co-acrylic acid) (30/70 weight ratio)

poly(ethyl acrylate-co-acrylic acid) (15/85 weight ratio)

poly(methyl acrylate-co-acrylic acid) (30/70 weight ratio)

poly(propyl acrylate-co-acrylic acid) (25/75 weight ratio)

poly (pentyl acrylate-co-acrylic acid) (20/80 weight ratio)

poly(hexyl acrylate-co-acrylic acid) (5/95 weight ratio)

poly(isopropyl acrylate-co-acrylic acid) (15/85 weight ratio)

poly(n-butyl methacrylate-co-acrylic acid) (30/70 weight ratio)

poly(ethyl methacrylate-co-acrylic acid) (20/80 weight ratio)

poly(methyl methacrylate-co-acrylic acid) (30/70 weight ratio)

poly(propyl methacrylate-co-acrylic acid) (25/75 weight ratio)

poly(pentyl methacrylate-co-acrylic acid) (20/80 weight ratio)

poly(hexyl methacrylate-co-acrylic acid) (25/75 weight ratio)

poly(isopropyl methacrylate-co-acrylic acid) (15/85 weight ratio)

In a preferred embodiment of the invention, particularly good results are obtained with poly(acrylonitrile-co-vinylidene chloride-co-acrylic acid) (12/68/20 weight ratio), mixed with poly(n-butyl acrylate-co-acrylic acid) (30/70 weight ratio); poly(acrylonitrile-co-vinylidene chloride-co-acrylic acid) (10/72/18 weight ratio), mixed with poly(ethyl acrylate-co-acrylic acid) (15/85 weight ratio); and poly(acrylonitrile-co-vinylidene chloride-co-acrylic acid) (15/63/22 weight ratio), mixed with poly(hexyl methacrylate-co-acrylic acid) (25/75 weight ratio).

Particularly good results have been obtained using a solvent coating of the above polymer mixtures.

Suitable acrylic copolymers useful in our invention include the following:

poly(n-butyl acrylate-co-acrylic acid) (70/30 weight ratio)

poly(ethyl acrylate-co-acrylic acid) (80/20 weight ratio)

poly(methyl acrylate-co-acrylic acid) (70/30 weight ratio)

poly(propyl acrylate-co-acrylic acid) (75/25 weight ratio)

poly(pentyl acrylate-co-acrylic acid) (80/20 weight ratio)

poly(hexyl acrylate-co-acrylic acid) (95/5 weight ratio)

poly(isopropyl acrylate-co-acrylic acid) (85/15 weight ratio)

poly(n-butyl methacrylate-co-acrylic acid) (70/30 weight ratio)

poly(ethyl methacrylate-co-acrylic acid) (80/20 weight ratio)

poly(methyl methacrylate-co-acrylic acid) (70/30 weight ratio)

poly(propyl methacrylate-co-acrylic acid) (75/25 weight ratio)

poly(pentyl methacrylate-co-acrylic acid) (80/20 weight ratio)

poly(hexyl methacrylate-co-acrylic acid) (95/5 weight ratio)

poly(isopropyl methacrylate-co-acrylic acid) (85/15 weight ratio)

In a preferred embodiment of the invention, poly(n-butyl acrylate-co-acrylic acid) (70/30 weight ratio), poly(ethyl acrylate-co-acrylic acid) (80/20 weight ratio) and poly(hexyl methacrylate-co-acrylic acid) (75/25 weight ratio) have given good results.

We have obtained particularly good results when the above acrylic acid copolymers are coated as a latex.

The dye image-providing material useful in our invention is either positive- or negative-working, and is either initially mobile or immobile in the photographic element during processing with an alkaline composition. Examples of initially mobile, positive-working dye image-providing materials useful in our invention are described in U.S. Pat. Nos. 2,983,606; 3,536,739; 3,705,184; 3,482,972; 2,756,142; 3,880,658 and 3,854,985. Examples of negative-working dye image-providing materials useful in our invention include conventional couplers which react with oxidized aromatic primary amino color developing agents to produce or release a dye such as those described, for example, in U.S. Pat. No. 3,227,550 and Canadian Patent No. 602,607. In a preferred embodiment of our invention, the dye-providing material is a ballasted, redox-dye-releasing (RDR) compound. Such compounds are well known to those skilled in the art and are, generally speaking, compounds which will react with oxidized or unoxidized developing agent or electron transfer agent to release a dye. Such nondiffusible RDR's include positive-working compounds, as described in U.S. Pat. Nos. 3,980,479; 4,139,379; 4,139,389; 4,199,354 and 4,199,355. Such non-diffusible RDR's also include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; German Patents 2,505,248 and 2,729,820; *Research Disclosure* 15157, November, 1876 and *Research Disclosure* 15654, April, 1977.

In a preferred embodiment of our invention, the dye-releasers such as those in the Fleckenstein et al patent referred to above are employed. Such compounds are ballasted sulfonamido compounds which are alkali-cleavable upon oxidation to release a diffusible dye from the nucleus and the formula:

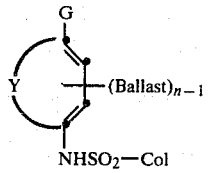

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is $OR_2$ or $NHR_3$ wherein $R_2$ is hydrogen or a hydrolyzable moiety and $R_3$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (when $R_3$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazolone or pyrimidine; and (e) n is a positive integer or 1 to 2 and is 2 when G is $OR_2$ or when $R_3$ is a hydrogen or an alkyl group of less than 8 carbon atoms.

For further details concerning the above-described sulfonamido compounds and specific examples of same, reference is made to the above-mentioned Fleckenstein et al U.S. Pat. No. 4,076,529 referred to above.

In another preferred embodiment of our invention, positive-working, nondiffusible RDR's of the type disclosed in U.S. Pat. Nos. 4,139,379 and 4,139,389 are employed. In this embodiment, an immobile compound is employed which as incorporated in a photographic element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement (BEND) compounds.

BEND compounds are ballasted compounds that undergo intramolecular nucleophilic displacement to release a diffusible moiety, such as a dye. They contain a precursor for a nucleophilic group which accepts at least one electron before the compound can undergo intramolecular nucleophilic displacement. In a preferred embodiment described in U.S. Pat. No. 4,139,379, the BEND compounds are processed in silver halide photographic elements with an electron transfer agent and an electron donor (i.e., a reducing agent) which provides the necessary electrons to enable the compound to be reduced to a form which will undergo intramolecular nucleophilic displacement. In this embodiment, the BEND compound reacts with the electron donor to provide a nucleophilic group which in turn enters into an intramolecular nucleophilic displacement reaction to displace a diffusible dye from the compound. However, where there are no electrons transferred to the electron accepting nucleophilic precursor, it remains incapable of displacing the diffusible dye. An imagewise distribution of electron donor is obtained in the photographic element by oxidizing the electron donor in an imagewise pattern before it has reacted with the BEND compound, leaving a distribution of unoxidized electron donor available to transfer electrons to the BEND compound. An imagewise distribution of oxidized electron donor is provided by reaction of the electron donor with an imagewise distribution of oxidized electron transfer agent, which in turn is obtained by reaction of a uniform distribution of electron transfer agent with an imagewise pattern of developable silver halide.

Thus, in processing an imagewise-exposed photographic element containing a BEND compound, the following reactions lead to an imagewise distribution of diffusible dye: In exposed areas, developable silver halide is developed by electron transfer agent, thereby providing oxidized electron transfer agent which reacts with and oxidizes electron donor, thus preventing it from reacting with BEND compound. In unexposed areas, there is no developable silver halide and, hence, neither electron transfer agent nor electron donor are oxidized. Thus, electron donor reacts with BEND compound to release diffusible dye.

The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 g/m$^2$ has been found to be useful. The dye image-providing material is dispersed in a hydrophilic film forming natural material or synthetic polymer, such as gelatin or polyvinyl alcohol, which is adapted to be permeated by aqueous alkaline processing composition.

A variety of silver halide developing agents are useful in this invention. Specific examples of developers or electron transfer agents (ETA) compounds useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol or 4-(N-octadecylamino)catechol; phenylenediamine compounds, such as N,N-diethyl-p-phenylenediamine, 3-methyl-N,N-diethyl-p-phenylenediamine, 3-methoxy-N-ethyl-N-ethoxy-p-phenylenediamine or N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. While such developing agents may be employed in the liquid processing composition, we have obtained good results when the ETA is incorporated in a layer or layers of the photographic element or receiving element to be activated by the alkaline processing composition, such as in the silver halide emulsion layers, the dye image-providing material layers, interlayers, or the image-receiving layer.

In using dye image-providing materials in the invention which produce diffusible dye images as a function of development, either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted, redox, dye-releasers. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Any material is useful as the dye image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

The polymeric acid layer employed in this invention will effect a reduction in the pH of the image layer from about 13 or 14 to at least 11, and preferably 5 to 8 within 3 to 4 minutes after imbibition. Such polymeric acids comprise polymers containing acid groups, such as carboxylic acid groups, which are capable of forming salts with alkali metals, such as sodium or potassium, or with organic bases, particularly quaternary ammonium bases, such as tetramethyl ammonium hydroxide. The polymers can also contain potentially acid-yielding groups, such as anhydrides or lactones or other groups which are capable of reacting with bases to capture and retain them. Generally, the most useful polymeric acids contain free carboxyl groups, being insoluble in water in the free acid form and which form water-soluble sodium and/or potassium salts. Examples of suitable polymeric acids include dibasic acid half-ester derivatives of cellulose, which derivatives contain free carboxyl groups, e.g., cellulose acetate hydrogen phthalate, cellulose acetate hydrogen succinate, ethyl cellulose hydrogen succinate, ethyl cellulose acetate hydrogen succinate, carboxymethyl cellulose, polyvinyl hydrogen phthalate, polyvinyl acetate hydrogen phthalate, acetals of polyvinyl alcohol with carboxy-substituted aldehydes, e.g., o-, m- or p-benzaldehyde carboxylic acid; partial esters of ethylene/maleic anhydride copolymers; partial esters of methyl vinyl ether/maleic anhydride copolymers; poly(methyl vinyl ether-co-maleic anhydride); poly(ethylene-co-maleic anhydride); polystyrene-co-maleic anhydride); and poly(dioxene-co-maleic anhydride); hydrolyzed or cyclized poly(vinyl acetate-co-maleic anhydride); or poly(methacryloyloxyethylphosphonic acid).

Particularly good results have been obtained with polymers and copolymers of acrylic acid, such as polyacrylic acid, partial esters or completely hydrolyzed polymers of polymethacrylic acid, poly(acrylic acid-coethyl acrylate), poly(acrylic acid-co-methylolacrylamide); poly(acrylic acid-co-butyl acrylate); poly(acrolein-coacrylic acid); poly(acrylic acid-co-hydroxyethyl acrylate); poly(butyl methacrylate-co-methacrylic acid); or poly(methyl methacrylate-co-methacrylic acid).

One or more timing or inert spacer layers can be employed in the practice of this invention over the polymeric acid layer which "times" or controls the pH reduction as a function of the rate at which the alkaline composition diffuses through the timing layer or layers. Such timing layers include hydrolyzable polymers or a mixture of such polymers which are slowly hydrolyzed by the processing composition. Examples of such hydrolyzable polymers include cellulose derivatives such as cellulose acetate phthalate, ethyl cellulose phthalate, a combination of cellulose acetate phthalate and ethyl cellulose phthalate, cellulose acetate hexahydrophthalate, cellulose acetate stearate, cellulose triacetate, cellulose acetate butyrate, and mixtures of cellulose esters; vinyl and acrylate polymers such as poly(phenyl acrylate), poly(cyanomethyl acrylate), poly(methoxymethyl acrylate), poly(ethoxycarbonylmethyl acrylate), poly(methacryloyloxyacetamide), partly hydrolyzed poly(vinyl acetate), poly(methacrylic acid-co-methyl methacrylate) and poly(vinyl acetate-co-maleic anhydride) treated to form an intramolecular ester-lactone. Particularly good results have been obtained with a lactone polymer, such as a partially hydrolyzed and 1-butanol esterified poly(vinyl acetate-comaleic anhydride) either alone or mixed with a poly(acrylonitrile-co-vinylidene chloride-co-acrylic acid) terpolymer, as described in copending U.S. Application Ser. No. 948,062, filed Oct. 2, 1978 of Abel, the disclosure of which is hereby incorporated by reference, or a mixture of cellulose acetate with a copolymer of styrene and maleic anhydride.

The alkaline processing or activator composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11. In some embodiments of the invention, the processing composition may contain a developing agent. Suitable materials and addenda frequently added to such compositions are disclosed on pages 79 and 80 of the November, 1976 edition of *Research Disclosure,* the disclosure of which is hereby incorporated by reference.

The supports for the photographic element and receiving element used in this invention can be any material, as long as it does not deleteriously affect the photographic properties and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

(A) A control photosensitive (donor) element is prepared by coating the following layers in the order recited on an opaque poly(ethylene terephthalate) film support:

(1) Polymeric acid layer of poly(n-butyl acrylate-co-acrylic acid) (30/70 weight ratio) equivalent to 81 meq. acid/m$^2$, hardened with 2.5 percent of 1,4-butanediol diglycidyl ether (2) Timing layer of a 10:90 physical mixture of poly(acrylonitrile-co-vinylidene chloride-co-acrylic acid) latex (weight ratio 14/79/7) and a lactone polymer, partially hydrolyzed, and 1-butanol transesterified poly(vinyl acetate-co-maleic anhydride), normal ratio of acid/butyl ester 15/85, as described in Abel U.S. Application Ser. No. 948,062, filed Oct. 2, 1978

(3) Interlayer of "gel nitrate"

(4) Image layer of gelatin (1.6 g/m$^2$), cyan RDR (0.32 g/m$^2$), and a negative-working silver halide emulsion layer (0.20 g/m$^2$)

(5) Gelatin layer (5.2 g/m$^2$)

(6) Overcoat layer of gelatin (0.88 g/m$^2$), Ludox AM® colloidal silica (duPont) (0.43 g/m$^2$), and 2,5-di-dodecylhydroquinone (0.32 g/m$^2$)

The cyan RDR is similar to those described in *Research Disclosure* No. 18268, Volume 182, July 1979, pages 329 through 331. The silver halide emulsion layers are conventional negative-working, 0.25 to 0.65$\mu$ silver chloride emulsions.

The "gel nitrate" composition consisted of the following (by weight):

0.61 percent gelatin
0.29 percent cellulose nitrate
0.06 percent salicyclic acid
0.01 percent chromium chloride
1.2 percent water
77.8 percent acetone
20.0 percent methanol (B) A donor element according to the invention is prepared similar to control donor (A), except that a primer layer of "gel nitrate" is coated at a concentration of 0.22 g/m$^2$ between layers 1 and 2.

(C) A donor element according to the invention is prepared similar to control donor (A), except that a primer layer of poly(ethyl acrylate-co-acrylic acid) (80 to 20 weight ratio) latex is coated at a concentration of 0.54 g/m$^2$ between layers 1 and 2.

(D) A donor element according to the invention is prepared similar to control donor (A), except that a primer layer of a mixture of poly(n-butyl acrylate-co-acrylic acid) (30 to 70 weight ratio) (0.81 g/m$^2$) and poly(acrylonitrile-co-vinylidene chloride-co-acrylic acid) (12/68/20 weight ratio) (0.54 g/m$^2$) is employed between layers 1 and 2. This mixture was coated from a solution of 91.7 percent acetone, 3.3 percent water, 3 percent of the acrylic acid copolymer and 2 percent of the acrylic acid terpolymer.

A dye image-receiving element was then prepared by coating the following layers in the order recited on an opaque paper support:

(1) Dye image-receiving layer of poly(1-vinyl-2-methylimidazole) (3.2 g/m$^2$) and gelatin (1.1 g/m$^2$)

(2) Interlayer of gelatin (0.86 g/m$^2$) and a UV absorber 2-(2-hydroxy-3,5-di-t-amylphenylbenzotriazole (0.54 g/m$^2$)

(3) Overcoat of gelatin (0.65 g/m$^2$)

The total amount of gelatin in these layers was 2.6 g/m$^2$, hardened with formaldehyde.

An activator solution was prepared containing:

Potassium hydroxide: 0.6 N
5-Methylbenzotriazole: 3.0 g/l
11-Aminoundecanoic acid: 2.0 g/l
Potassium bromide: 2.0 g/l Samples of the above donor elements were flashed to maximum density, soaked in the activator solution above contained in a shallow-tray processor for 15 seconds at 28° C., and then laminated between nip rollers to dry samples of the receiving element. After 4 minutes and 10 minutes, various donors and receivers were pulled apart. The transfer of the emulsion and/or timing layers, if any, from the donor was visually observed. The following results were obtained:

TABLE I

| Donor | Primer Layer | Lamination Time (Minutes) | Estimated Area of Emulsion Transferred |
|---|---|---|---|
| A (control) | None | 10 | 20 percent |
| B | "Gel nitrate" | 10 | 0 percent |
| C | Acrylic acid copolymer | 10 | 0 percent |
| A (control) | None | 4 | 80 percent |
| D | Mixture of acrylic acid copolymer and acrylic acid terpolymer | 4 | 5 percent |

The above results indicate that use of the primer layers according to our invention substantially reduces or eliminates unwanted transfer of emulsion and/or timing layers to the receiver after peel-apart.

EXAMPLE 2

Example 1 was repeated at the 10-minute lamination time, except that different primer layer materials were used, as shown in the following Table II. The percent area of emulsion transferred was estimated and the primer layers were ranked for wet adhesion according to the following definitions:

Good—0 to 5 percent of emulsion transferred
Fair—5 to 10 percent of emulsion transferred
Poor—Greater than 10 percent of emulsion transferred

TABLE II

| Primer Layer | Coverage ($g/m^2$) | Wet Adhesion |
|---|---|---|
| Mixture of AN—VC—AA (12/68/20 | 0.54 | |
| wt. %) and BA—AA (30/70 wt. %) | 0.81 | Fair to good |
| Mixture of AN—VC—AA (12/68/20 | 0.27 | |
| wt. %) and BA—AA (30/70 wt. %) | 0.81 | Fair to good |
| Mixture of AN—VC—AA (12/68/20 | 0.16 | |
| wt. %) and BA—AA (30/70 wt. %) | 0.81 | Good |
| AN—VC—AA (12/68/20 wt. %) (control) | 0.54 | Poor |
| AN—VC—AA (13/73/14 wt. %) (control) | 0.54 | Poor |
| AN—VC—AA (14/76/10 wt. %) (control) | 0.54 | Poor |
| BA—AA (50/50 wt. %) (control) | 0.54 | Fair |
| Mixture of AN—VC—AA (14/80/6 | 0.27 | Poor |
| wt. %) and L (control) | 0.27 | |
| Mixture of | | |
| AN—VC—AA (13/73/14 | 0.27 | |
| wt. %) and S (control) | 0.27 | Fair |
| Mixture of Gelatin and MEM—HA | 0.27 | |
| (20/80 wt. %) (control) | 0.81 | Poor |
| BA—MMS (25/75 wt. %) (control) | 0.54 | Poor |

Monomer and Polymer Identification

AN—acrylonitrile
VC—vinylidene chloride
AA—acrylic acid
BA—n-butyl acrylate
S—polystyrene
MEM—2-(methacryloyloxy)ethyltrimethylammonium methosulfate
HA—2-hydroxyethyl acrylate
MMS—2-methacrylamido-2-methylpropanesulfonic acid
L—a butyl ester lactone acid made from vinyl acetate-maleic anhydride copolymer such as described in Example 1 of U.S. Pat. No. 3,260,706

Other than S and L, copolymers were employed using the above-identified monomers in the weight ratios given.

The above results indicate that the polymeric mixtures according to our invention provide useful results, while the use of either of the acrylic acid copolymer or the acrylic acid terpolymer alone of the polymeric mixtures of our invention does not provide useful results. In addition, mixtures of acrylic acid terpolymers with other polymers do not provide useful results, either. The results also indicate that acrylate polymers other than those copolymerized with acrylic acid as described herein do not provide useful results, either.

The invention has been described in detail with particular reference to preferred embodiments thereof, but it will be understood that variations and modifications can be effected within the spirit and scope of the invention.

What is claimed is:

1. In a photographic element comprising a support having thereon, in order, a polymeric acid layer, a timing layer and at least one unexposed photosensitive silver halide emulsion layer having associated therewith a dye image-providing material, the improvement wherein a primer layer is located between said polymeric acid layer and said timing layer, said primer layer comprising:

(a) a mixture of gelatin and cellulose nitrate; or (b) a mixture of an acrylic acid copolymer and an acrylic acid terpolymer, said acrylic acid copolymer comprising 60 to 90 weight percent of recurring units derived from acrylic acid and 10 to 40 weight percent of recurring units derived from an alkyl acrylate or alkyl methacrylate, wherein said alkyl group has 1 to about 10 carbon atoms, said acrylic acid terpolymer comprising 5 to 40 weight percent of recurring units derived from acrylic acid, 10 to 40 weight percent of recurring units derived from acrylonitrile and 20 to 85 weight percent of recurring units derived from vinylidene chloride, said acrylic acid copolymer comprising from about 40 to about 90 weight percent of said mixture; or (c) an acrylic acid copolymer comprising 5 to 30 weight percent of recurring units derived from acrylic acid and 70 to 95 weight percent of recurring units derived from an alkyl acrylate or alkyl methacrylate, wherein said alkyl group has 1 to about 10 carbon atoms.

2. The photographic element of claim 1 wherein said primer layer comprises a mixture of:

(a) an acrylic acid copolymer comprising 60 to 90 weight percent of recurring units derived from acrylic acid and 10 to 40 weight percent of recurring units derived from n-butyl acrylate; and (b) an acrylic acid terpolymer comprising 5 to 40 weight percent of recurring units derived from acrylic acid, 10 to 40 weight percent of recurring units derived from acrylonitrile, and 20 to 85 weight percent of recurring units derived from vinylidene chloride, said acrylic acid copolymer comprising from about 70 to about 85 weight percent of said mixture.

3. The photographic element of claim 1 wherein said primer layer is poly(n-butyl acrylate-co-acrylic acid) (70/30 weight ratio) or poly(ethyl acrylate-co-acrylic acid) (80/20 weight ratio).

4. The photographic element of claim 1 wherein said primer layer comprises a mixture of: (a) poly(n-butyl acrylate-co-acrylic acid) (30/70 weight ratio) and (b) poly(acrylonitrile-co-vinylidene chloride-co-acrylic acid) (12/68/20 weight ratio), said acrylic acid copolymer comprising about 70 to about 85 weight percent of said mixture.

5. The photographic element of claim 1 wherein said primer layer comprises a mixture of gelatin and cellulose nitrate, said cellulose nitrate comprising from about 1 to about 70 weight percent of the mixture.

6. The photographic element of claim 1 wherein said dye image-providing material is a ballasted, redox dye-releaser.

7. The photographic element of claim 1 wherein said dye image-providing material is a ballasted sulfonamido compound which is alkali-cleavable upon oxidation to release a diffusible color-providing moiety, said compound having the formula:

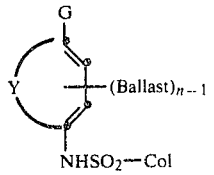

wherein:

(a) Col is a dye or dye precursor moiety;

(b) Ballast is an organic ballasting radical of such molecular size and configuration as to render the compound nondiffusible in the photographic element during development in an alkaline processing composition;

(c) G is $OR_2$ or $NHR_3$ wherein $R_2$ is hydrogen or a hydrolyzable moiety and $R_3$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) n is a positive integer or 1 to 2 and is 2 when G is $OR_2$ or when $R_3$ is a hydrogen or an alkyl group of less than 8 carbon atoms.

8. The photographic element of claim 7 wherein G is OH, n is 2 and Y is a naphthalene nucleus.

9. The photographic element of claim 1 wherein said silver halide emulsion is a direct-positive silver halide emulsion.

10. The photographic element of claim 1 wherein said dye image-providing material is a ballasted, electron-accepting nucleophilic displacement compound.

11. In a photographic element comprising a support having thereon, in order, a polymeric acid layer, a timing layer, an unexposed red-sensitive silver halide emulsion layer having associated therewith a cyan dye image-providing material, an unexposed green-sensitive silver halide emulsion layer having associated therewith a magenta dye image-providing material, and an unexposed blue-sensitive silver halide emulsion layer having associated therewith a yellow dye image-providing material, the improvement wherein a primer layer is located between said polymeric acid layer and said timing layer, said primer layer comprising:

(a) a mixture of gelatin and cellulose nitrate; or (b) a mixture of an acrylic acid copolymer and an acrylic acid terpolymer, said acrylic acid copolymer comprising 60 to 90 weight percent of recurring units derived from acrylic acid and 10 to 40 weight percent of recurring units derived from an alkyl acrylate or alkyl methacrylate, wherein said alkyl group has 1 to about 10 carbon atoms, said acrylic acid terpolymer comprising 5 to 40 weight percent of recurring units derived from acrylic acid, 10 to 40 weight percent of recurring units derived from acrylonitrile and 20 to 85 weight percent of recurring units derived from vinylidene chloride, said acrylic acid copolymer comprising from about 40 to about 90 weight percent of said mixture; or (c) an acrylic acid copolymer comprising 5 to 30 weight percent of recurring units derived from acrylic acid and 70 to 95 weight percent of recurring units derived from an alkyl acrylate or alkyl methacrylate, wherein said alkyl group has 1 to about 10 carbon atoms.

12. In a photographic assemblage comprising:

(I) a photographic element comprising a support having thereon, in order, a polymeric acid layer, a timing layer and at least one photosensitive silver halide emulsion layer having associated therewith a dye image-providing material; and (II) a dye image-receiving element comprising a support having thereon a dye image-receiving layer, said receiving element being adapted to be superposed on said photographic element after exposure thereof;

the improvement wherein a primer layer is located between said polymeric acid layer and said timing layer, said primer layer comprising;

(a) a mixture of gelatin and cellulose nitrate; or (b) a mixture of an acrylic acid copolymer and an acrylic acid terpolymer, said acrylic acid copolymer comprising 60 to 90 weight percent of recurring units derived from acrylic acid and 10 to 40 weight percent of recurring units derived from an alkyl acrylate or alkyl methacrylate, wherein said alkyl group has 1 to about 10 carbon atoms, said acrylic acid terpolymer comprising 5 to 40 weight percent of recurring units derived from acrylic acid, 10 to 40 weight percent of recurring units derived from acrylonitrile and 20 to 85 weight percent of recurring units derived from vinylidene chloride, said acrylic acid copolymer comprising from about 40 to about 90 weight percent of said mixture; or (c) an acrylic acid copolymer comprising 5 to 30 weight percent of recurring units derived from acrylic acid and 70 to 95 weight percent of recurring units derived from an alkyl acrylate or alkyl methacrylate, wherein said alkyl group has 1 to about 10 carbon atoms.

13. The photographic assemblage of claim 12 wherein said primer layer comprises a mixture of:

(a) an acrylic acid copolymer comprising 60 to 90 weight percent of recurring units derived from acrylic acid and 10 to 40 weight percent of recurring units derived from n-butyl acrylate; and (b) an acrylic acid terpolymer comprising 5 to 40 weight percent of recurring units derived from acrylic acid, 10 to 40 weight percent of recurring units derived from acrylonitrile, and 20 to 85 weight percent of recurring units derived from vinylidene chloride, said acrylic acid copolymer comprising from about 70 to about 85 weight percent of said mixture.

14. The photographic assemblage of claim 12 wherein said primer layer is poly(n-butyl acrylate-co-acrylic acid) (70/30 weight ratio) or poly(ethylacrylate-co-acrylic acid) (80/20 weight ratio).

15. The photographic assemblage of claim 12 wherein said primer layer comprises a mixture of: (a) poly(n-butyl acrylate-co-acrylic acid) (30/70 weight ratio) and (b) poly(acrylonitrile-co-vinylidene chloride-co-acrylic acid) (12/68/20 weight ratio), said acrylic acid copolymer comprising about 70 to about 85 weight percent of said mixture.

16. The photographic assemblage of claim 12 said primer layer comprises a mixture of gelatin and cellulose nitrate, said cellulose acetate comprising from about 1 to about 70 weight precent of the mixture.

17. In a photographic assemblage comprising:

(I) a support having thereon, in order, a polymeric acid layer, a timing layer, a red-sensitive silver halide emulsion layer having associated therewith a cyan dye image-providing material, a green-sensitive silver halide emulsion layer having associated therewith a magenta dye image-providing material, and a blue-sensitive silver halide emulsion layer having associated therewith a yellow dye image-providing material; and (II) a dye image-receiving element comprising a support having thereon a dye image-receiving layer, said receiving element being adapted to be superposed on said photographic element after exposure thereof;

the improvement wherein a primer layer is located between said polymeric acid layer and said timing layer, said primer layer comprising:

(a) a mixture of gelatin and cellulose nitrate; or (b) a mixture of an acrylic acid copolymer and an acrylic acid terpolymer, said acrylic acid copolymer comprising 60 to 90 weight percent of recurring units derived from acrylic acid and 10 to 40 weight percent of recurring units derived from an alkyl acrylate or alkyl methacrylate, wherein said alkyl group has 1 to about 10 carbon atoms, said acrylic acid terpolymer comprising 5 to 40 weight percent of recurring units derived from acrylic acid, 10 to 40 weight percent of recurring units derived from acrylonitrile and 20 to 85 weight percent of recurring units derived from vinylidene chloride, said acrylic acid copolymer comprising from about 40 to about 90 weight percent of said mixture; or (c) an acrylic acid copolymer comprising 5 to 30 weight percent of recurring units derived from acrylic acid and 70 to 95 weight percent of recurring units derived from an alkyl acrylate or alkyl methacrylate, wherein said alkyl group has 1 to about 10 carbon atoms.

18. In a process for producing a photographic image wherein an exposed photographic element is immersed in a processing solution, said photographic element comprising a support having thereon, in order, a polymeric acid layer, a timing layer and at least one photosensitive silver halide emulsion layer having associated therewith a dye image-providing material, said photographic element then being brought into face-to-face contact for a period of time with a dye image-receiving element, said receiving element comprising a support having thereon a dye image-receiving layer, said receiving element then being separated from said photographic element, the improvement which comprises preventing transfer of portions of said emulsion layer to said dye image-receiving element during processing by means of a primer layer located between said polymeric acid layer and said timing layer, said primer layer comprising:

(a) a mixture of gelatin and cellulose nitrate; or (b) a mixture of an acrylic acid copolymer and an acrylic acid terpolymer, said acrylic acid copolymer comprising 60 to 90 weight percent of recurring units derived from acrylic acid and 10 to 40 weight percent of recurring units derived from an alkyl acrylate or alkyl methacrylate, wherein said alkyl group has 1 to about 10 carbon atoms, said acrylic acid terpolymer comprising 5 to 40 weight percent of recurring units derived from acrylic acid, 10 to 40 weight percent of recurring units derived from acrylonitrile and 20 to 85 weight percent of recurring units derived from vinylidene chloride, said acrylic acid copolymer comprising from about 40 to about 90 weight percent of said mixture; or (c) an acrylic acid copolymer comprising 5 to 30 weight percent of recurring units derived from acrylic acid and 70 to 95 weight percent of recurring units derived from an alkyl acrylate or alkyl methacrylate, wherein said alkyl group has 1 to about 10 carbon atoms.

19. The process of claim 18 wherein said primer layer comprises a mixture of:

(a) an acrylic acid copolymer comprising 60 to 90 weight percent of recurring units derived from acrylic acid and 10 to 40 weight percent of recurring units derived from n-butyl acrylate; and (b) an acrylic acid terpolymer comprising 5 to 40 weight percent of recurring units derived from acrylic acid, 10 to 40 weight percent of recurring units derived from acrylonitrile, and 20 to 85 weight percent of recurring units derived from vinylidene chloride, said acrylic acid copolymer comprising from about 70 to about 85 weight percent of said mixture.

20. The process of claim 18 wherein said primer layer is poly(n-butyl acrylate-co-acrylic acid) (70/30 weight ratio) or poly(ethyl acrylate-co-acrylic acid) (80/20 weight ratio).

21. The process of claim 18 wherein said primer layer comprises a mixture of: (a) poly(n-butyl acrylate-co-acrylic acid) (30/70 weight ratio) and (b) poly(acrylonitrile-co-vinylidene chloride-co-acrylic acid) (12/68/20 weight ratio), said acrylic acid copolymer comprising about 70 to about 85 weight percent of said mixture.

22. The process of claim 18 wherein said primer layer comprises a mixture of gelatin and cellulose nitrate, said cellulose nitrate comprising from about 1 to about 70 weight percent of the mixture.

23. In a process for producing a photographic image wherein an exposed photographic element is immersed in a processing solution, said photographic element comprising a support having thereon, in order, a polymeric acid layer, a timing layer, a red-sensitive silver halide emulsion layer having associated therewith a cyan dye image-providing material, a green-sensitive silver halide emulsion layer having associated therewith a magenta dye image-providing material, and a blue-sensitive silver halide emulsion layer having associated therewith a yellow dye image-providing material, said photographic element then being brought into face-to-face contact for a period of time with a dye image-receiving element, said receiving element comprising a support having thereon a dye image-receiving layer, said receiving element then being separated from said photographic element, the improvement which comprises preventing transfer of portions of said emulsion layers to said dye image-receiving element during processing by means of a primer layer located between said polymeric acid layer and said timing layer, said primer layer comprising:

(a) a mixture of gelatin and cellulose nitrate; or (b) a mixture of an acrylic acid copolymer and an acrylic acid terpolymer, said acrylic acid copolymer comprising 60 to 90 weight percent of recurring units derived from acrylic acid and 10 to 40 weight percent of recurring units derived from an alkyl acrylate or alkyl methacrylate, wherein said alkyl group has 1 to about 10 carbon atoms, said acrylic acid terpolymer comprising 5 to 40 weight percent of recurring units derived from acrylic acid, 10 to 40 weight percent of recurring units derived from acrylonitrile and 20 to 85 weight percent of recurring units derived from vinylidene chloride, said acrylic acid copolymer comprising from about 40 to about 90 weight percent of said mixture; or (c) an acrylic acid copolymer comprising 5 to 30 weight percent of recurring units derived from acrylic acid and 70 to 95 weight percent of recurring units derived from an alkyl acrylate or alkyl methacrylate, wherein said alkyl group has 1 to about 10 carbon atoms.

* * * * *